United States Patent [19]

Oermann

[11] Patent Number: 5,044,635

[45] Date of Patent: Sep. 3, 1991

[54] POP BUMPER FOR PINBALL GAME

[75] Inventor: David P. Oermann, Chicago, Ill.

[73] Assignee: Data East Pinball, Inc., Melrose Park, Ill.

[21] Appl. No.: 542,116

[22] Filed: Jun. 22, 1990

[51] Int. Cl.[5] ..... A63F 7/00

[52] U.S. Cl. ..... 273/127 R; 273/129 S; 200/61.11

[58] Field of Search ..... 273/118 A, 119 A, 121 A, 273/122 A, 127 R, 127 A, 127 C, 129 S; 200/61.11

[56] References Cited

U.S. PATENT DOCUMENTS

| | | | |
|---|---|---|---|
| 3,180,645 | 4/1965 | Seiden et al. | 273/118 A |
| 3,180,646 | 4/1965 | Zale et al. | 273/118 A |
| 3,785,653 | 1/1974 | Halliburton | 273/127 R |
| 3,877,701 | 4/1975 | Foster et al. | 273/119 A |
| 4,097,047 | 6/1978 | Ochi | 273/127 R |
| 4,223,889 | 9/1980 | Konta | 273/127 R |
| 4,225,135 | 9/1980 | Bailey | 273/121 A |
| 4,429,876 | 2/1984 | Halliburton et al. | 273/127 C |

*Primary Examiner*—Edward M. Coven
*Assistant Examiner*—Raleigh W. Chiu
*Attorney, Agent, or Firm*—Gerstman & Ellis, Ltd.

[57] ABSTRACT

A "pop bumper" for a pinball game which carries a depressible flange for contact with a rolling ball. By this invention a vertically moveable pin engaging the flange is provided. The pin is positioned to move in linear manner between a first vertical position when the flange is depressed and a second vertical position when the flange is not depressed. A spring is provided to urge the vertically movable pin toward one of the vertical positions, typically the second vertical position. A switch is actuated between open and closed positions as the pin moves between the first and second vertical positions. Various functions may be actuated by the switch. For example a ball thruster may be provided to thrust the ball away from the bumper when the vertically moveable pin is moved to typically the first vertical position in which the flange is depressed.

17 Claims, 1 Drawing Sheet

POP BUMPER FOR PINBALL GAME

BACKGROUND OF THE INVENTION

Pop bumpers are well known in electrically operated pinball machines. Such pop bumpers are generally distributed throughout the play field across which the ball rolls. When a pinball strikes a pop bumper, a switch is depressed which typically causes a score to be recorded. Also, typically, an angled ring is depressed by a solenoid against the ball, to forcefully impel or thrust the ball away from the bumper, for further play of the ball. The pop bumper is popular in electrically operated pinball machines because they can add added life and action to the ball, by providing it with added rolling energy.

In the presently available pop bumpers, a ball skirt or flange serves as a switch, being positioned to be depressed by the ball when the ball rolls against the pop bumper. Such ball skirts are typically circular plates with a downwardly facing concave side and an upwardly facing convex side. A generally vertical rod is welded or otherwise attached to the lower face of the ball skirt or flange, and projects downwardly into engagement with a dish carried on an arm, in which the dish carries an upwardly facing concave surface. Thus, as the skirt or flange is depressed from any side by a ball, the vertical rod is rotated outwardly. In so doing, it engages a peripheral portion of the dish on the arm, to force the dish and arm downwardly. This is typically accomplished because the radius of curvature of the concave dish is less than the radius of the arc in which the lower tip of the rod rotates.

The arm that carries the dish may be connected to a switch, so that when the dish is depressed by the rod rotating out of vertical alignment by depression of one edge of the ball skirt, the switch may be actuated to cause a score to be recorded, and to cause the means for thrusting the ball away from the pop bumper to be actuated.

Then, when the ball skirt or flange is no longer depressed by the ball, it rotates back to its normal position, taking the rod with it, which permits the dish and arm to be raised again to shut the switch off.

As a problem which has arisen with this design of pop bumper, it has been found that the vertical rod sometimes "hangs up" or becomes stuck in its engagement with a peripheral portion of the dish. Thus, the switch arm remains permanently depressed, and the switch in a permanently "on" position. Often because of this, the circuitry controlled by the switch burns out before the problem can be repaired.

In the past, the Bally Company attempted to solve this problem making use of a vertical rod positioned against a ball skirt or flange in which the vertical rod moved only upwardly and downwardly and not from side-to-side. The project was apparently unsuccessful because manufacturing of that structure was terminated rather quickly. It is believed that on problem that arose with respect to such a structure is that when a ball strikes the ball skirt or flange to depress it, the distance that the vertical rod is pressed downwardly is quite small. Sometimes, that distance was inadequate to reliably actuate the switch which was supposed to be in engagement with and controlled by movements of the rod.

In accordance with this invention, means are provided for causing movements of a vertical actuating rod to be magnified, so that such movements will cause a switch with which it interacts to be moved to a greater degree than the movements of the vertical rod. Thus, small movements of the vertical rod can nevertheless result in larger movements of the actuating arm of the switch, for example, resulting in reliable actuation of the switch when a ball rolls against the ball skirt or flange.

Further in accordance with this invention, an improved pop bumper is provided which is less likely to become stuck in the "on" position in the manner of the prior art. Nevertheless, the pop bumper functions in a manner which has the advantages of prior art pop bumpers while avoiding this problem, and while also being manufactured of more conventional parts which may be less expensive, for manufacturing cost advantages when compared with those of the prior art.

DESCRIPTION OF THE INVENTION

In this invention, a bumper is provided for a pinball game. The bumper carries a depressible flange for contact with a rolling ball, so that a peripheral portion of the flange may be depressed, as in the prior art, upon contact with the rolling ball. A vertically movable pin is positioned in a manner to engage the flange, and to move, typically in linear manner between a first vertical position when the flange is depressed, and a second vertical position when the flange is not depressed. Spring means are provided to urge the vertically movable pin toward one of the first or second vertical positions, typically the second vertical position. Switch means are provided, which switch means are actuated between open and closed positions as the pin moves between the first and second vertical positions.

Pivotable arm means are also provided, having a pivot point and a free end. The arm means engages the end of the vertically movable pin at a first position between the pivot point and the free end of the arm. The arm means also engages the switch means (i.e., typically an actuating arm thereof) at a second position which is closer to the free end of the arm means than the first position. As a result of this, movements of the pin can cause said engaging of the switch means in magnified manner, so that the switch means can be reliably turned on and shut off by relatively small movements of the vertical pin, as the pin, in turn, is actuated by the depressible flange which can be depressed by a rolling ball.

This engagement caused by the movements of the pin may be accomplished by the arm means engaging an actuator arm of a switch at the second position, which is closer to the free end of the arm means than the first position. This is as illustrated in the drawings. However, as an alternative, if an optical switch is used, the engagement of the switch means may be caused by movements of the pin by means of the arm means interrupting an optical beam as the second position of the arm swings to occlude the beam and thus engage the optical switch. Here also, engagement of the switch means takes place in magnified manner since the second position on the arm means can move a greater distance than the pin moves to any degree desired, depending upon the length of the pivotable arm means, since the longer the arm means is, the more its outer rotating tip will move relative to the amount of motion of the vertically movable pin.

Function means are also provided, being actuated by the switch means, for performing a desired function as controlled by the switch means.

Preferably, the function means comprises the means for thrusting the ball away from the bumper when the vertically movable pin is moved to that vertical position which is other than the position toward which the spring means urges. Typically, that other vertical position is the first vertical position. An added aspect of the function means may include means for transmitting a score signal to the score board of the pinball game every time the flange is depressed.

The depressible flange preferably defines one face that is in nonadhering contact with an end of the vertically moveable pin. Thus the flange, which typically defines a circular periphery, may rotate downwardly when struck by the ball in an direction. However, since the one face of the flange is in nonadhering contact with an end of the vertically moveable pin, the downward rotation of an edge of the flange can cause vertical, linear movement of the pin, not a rotating movement, from one vertical position to the other.

At the same time, the depressible flange defines a face opposed to the one face, and a preferably stationary abutment is provided which also is in nonadhering contact with the opposed face. Thus, the flange rotates to a limited degree when struck on its periphery by a rolling ball, but is limited in its vertically upward movement by its engagement with the stationary abutment, so that the flange can impart by its rotation a vertically downward movement to the moveable pin.

The flange may be preferably retained in place by means of stationary, vertical members which loosely extend through a plurality of apertures in the flange. The term "loosely extend" implies that the diameter of the apertures is somewhat larger than the diameter of the vertical members that pass through them, to permit the flange to be depressed at any point along its periphery by a rolling ball, to consequently depress the pin from its second to its first depressed vertical position.

The structure of this invention exhibits the advantages described above. Also, there is no need for a concave plate on the end of an arm as in the prior art, and thus there is no possibility of a pin attached the a depressible flange "hanging up" or sticking in its engagement with such plate.

DESCRIPTION OF THE INVENTION

Figure 1:
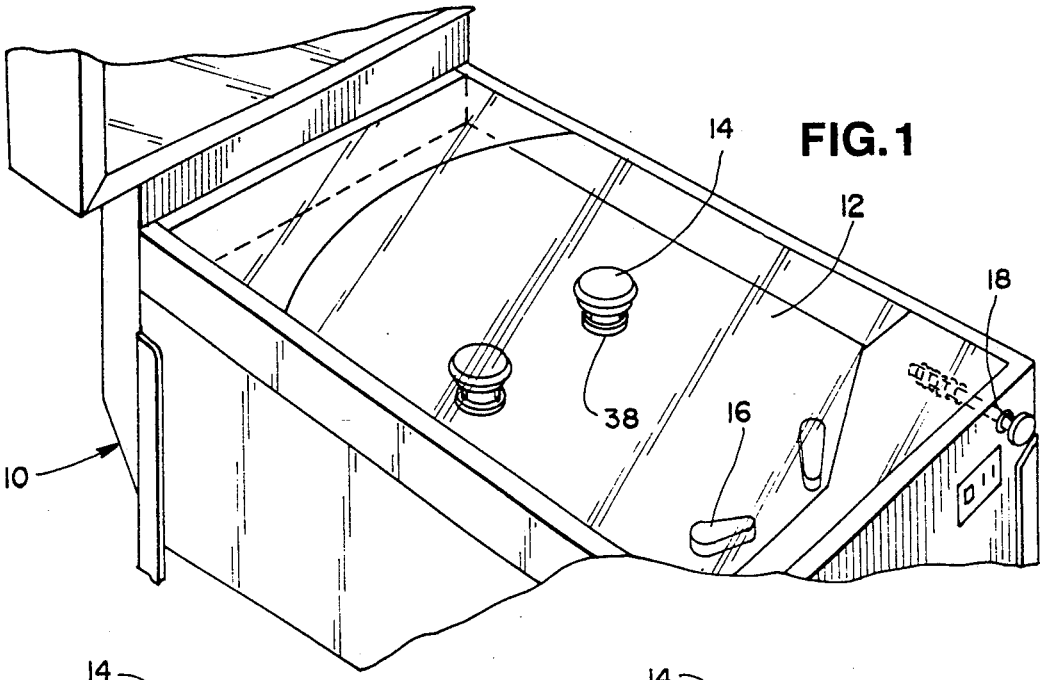
FIG. 1 is a fragmentary, perspective view of a pinball machine having pop bumpers in accordance with this invention.

Referring to the drawings, FIG. 1 shows a pinball machine that may be made according with the state of the art technology for electrically operated pinball machines, except as otherwise disclosed herein. As shown, pinball machine 10 defines a play field 12 which carries one or more pop bumpers 14. Typically, a normal pinball machine will have many more pop bumpers and other features carried on the play field along with flippers 16, but such details are omitted for purposes of clarity of the disclosure here. Also, ball launcher 18 is provided in conventional manner.

Figure 2:
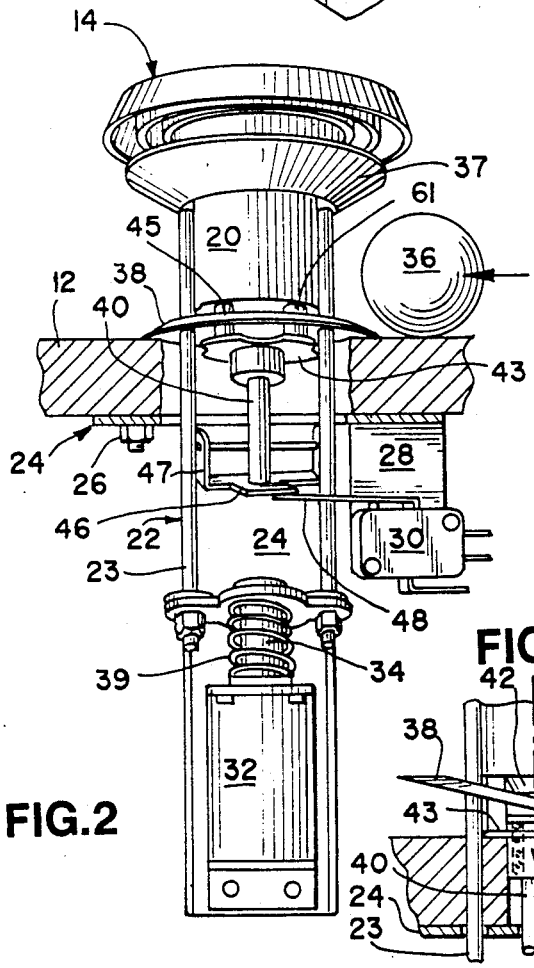
FIG. 2 is a longitudinal sectional view of a pop bumper in accordance with this invention, shown in one configuration.
Figure 3:
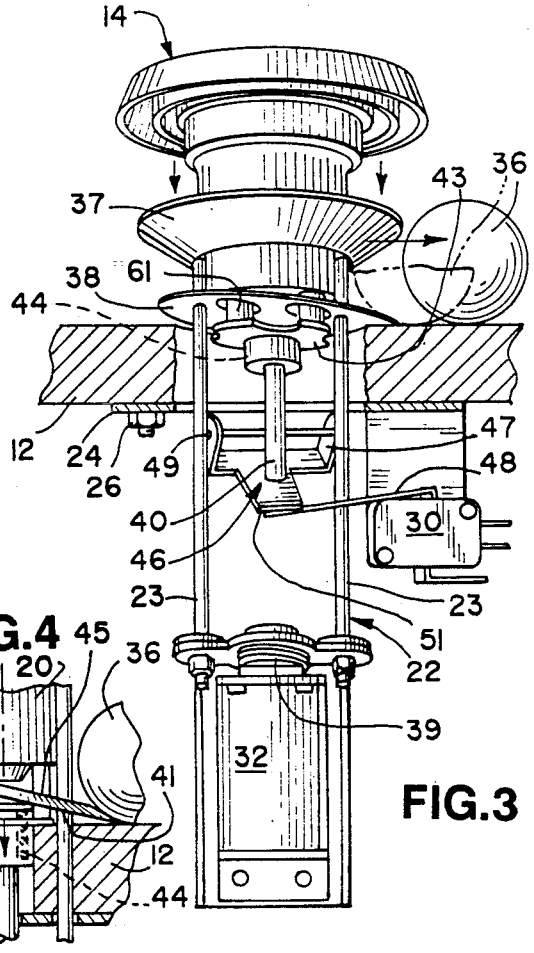
FIG. 3 is a longitudinal sectional view of the same pop bumper in another position of operation.

Pop bumper 14 is illustrated in longitudinal section in FIGS. 2 and 3, being carried on play field 12 by conventional bracket 24 and screws 26. Also, a central portion of play field 12 is removed from FIGS. 2 and 3 for clarity of disclosure. It may be desired for the vertically extending members of the pop bumper to extend through smaller holes in the play field as in FIG. 4 rather than providing a larger aperture corresponding to a larger cut away portion of FIGS. 2 and 3.

Pop bumper 14 defines a light socket 20, if desired, and a frame structure 22 comprising two or more vertical members or rods 23 which are carried to slidingly extend through the play field 12. Sheet metal bracket 24 has flanges for attachment of the bracket by one or more screws and nuts 26 or the like. Bracket extension 28 carries switch 30, typically a microswitch, which is electrically connected to an electric power circuit, by which switch 30 can control solenoid 32, which is carried on bracket 24.

Solenoid 32, in turn, has an actuating rod 34 that, on solenoid actuation, can depress the frame 22 made of the pair of rods 23, which lowers conventional ball propelling ring 37 carried by frame 22, to thrust ball 36 away from the pop bumper by the action shown in FIG. 3. Return spring 39 is present to return actuating rod 34 to its original position of FIG. 2 when solenoid 32 is not actuated.

In accordance with this invention, depressible flange 38, having a circular periphery, is provided. When a rolling ball 36 strikes the periphery of flange 38 at any point about the periphery, flange 38 will twist in the manner shown in FIG. 3, where a dotted line fragment of ball 36 is shown to be depressing a portion of the periphery of flange 38, while causing the portion of the flange opposite to the periphery to rise. See also FIG. 4.

Figure 4:
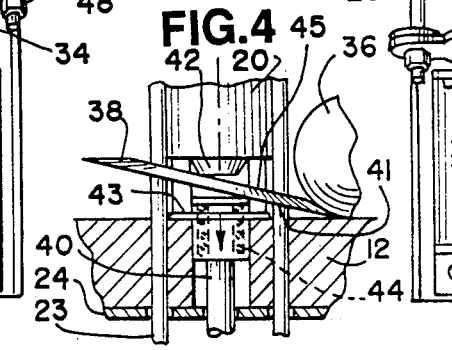
FIG. 4 is a fragmentary, longitudinal sectional view showing details of the pop bumper mechanism.

Vertically moveable pin 40 is provided, extending through plate 43, which may rest on the top surface on play field 12, or in a recess in the play field, if desired. Pin 40 is positioned to slide through an aperture in play field 12 to restrict its motion to only linear motion, which is particularly shown to be vertical in this embodiment. Flange 38 can be seen to be in abutting, nonadhering contact at one face 41 with the upper end of pin 40. Also, flange 38, on its opposed face 45, is in nonadhering contact with a stationary abutment 42, (FIG. 4) which may be defined on the lower surface of socket 20. Accordingly, as shown in FIG. 4, as a ball 36 rolls into contact with the periphery of flange 38 and forces it downwardly, abutment 42 serves as a fulcrum for rotation that causes the rotating flange 38 to depress pin 40 from its second vertical position as shown in FIG. 2 to its first vertical position as shown in FIGS. 3 and 4. Spring means 44 is provided to urge pin 40 back to its second vertical position when ball 36 is taken out of the way, to also restore flange 38 to its nondepressed position as shown in FIG. 2.

Flange 38 is retained in position by fixed rods 61 that fit loosely through apertures in flange 38.

The lower end of pin 40 rests in contact or near contact with a pivotable, flat arm 46, which communicates adjacent an end thereof with an actuator arm 48 of switch 30. Pivotable arm 46 may have its pivot point in side walls 47 of bracket 24, which is positioned behind vertical rods 23 as shown in FIGS. 2 and 3. It can be seen that pivotable arm 46 is engaged by pin 40 at a first position between pivot point 49 and the free end 51 of arm 46. Actuator arm 48 of switch 30, on the other hand, can be seen to engage pivotable arm 46 at a second position which is closer to free end 51 than the first position, typically being closely adjacent thereto.

Thus, as ball 36 depresses flange 38 and thus forces pin downwardly, it can be seen that actuator arm 48, being farther from pivot point 49 of flat arm 46 than is vertical pin 40, will be moved downwardly by a greater distance than the total distance of motion of pin 40. Hence, the system can be arranged so that even very small motions of pin 40 can easily cause actuation of switch 30, and the relative motions of pin 40 and actuator arm 48 can be simply controlled by the positioning of the respective arm 40 and switch 30 and the length of pivotable arm 46.

Thus, beginning with the configuration of FIG. 2, as ball 36 rolls into contact with flange 38, the flange is depressed as shown in FIGS. 3 and 4. This, in turn, causes vertically movable pin 40 to be depressed by the action most particularly demonstrated in FIG. 4. Pin 40, in turn, causes pivotable arm 46 to rotate downwardly, depressing switch arm 48 with magnified motion. That action actuates solenoid 32, so that rods 23, carrying ball thruster 37 with them, briskly move downwardly. The brisk, downwardly moving action of ball thruster 37 causes its sloping lower surface to engage ball 36, to forcefully thrust ball 36 away from pop bumper 14, to provide the ball with added kinetic energy and "life" for further pinball action. At the same time, a score can be electronically recorded on the score board by conventional circuitry, and any other desired function may also be performed.

Then, when ball 36 has been thrust away, spring 44 urges pin 40 upwardly again, which also causes flange 38 to assume its horizontal configuration that it occupies when pin 40 is in the second vertical position of FIG. 2.

Thus, pop bumper 14 can be seen to provide the desired function of conventional, prior art pop bumpers. However, pin 40 moves only in a linear manner, with the result that it is less likely to become stuck in one or the other of its vertical positions in a manner similar to the prior art. Rather, the pop bumper of this invention exhibits greater reliability of operation, as well as greater simplicity of functioning and parts, so that the pop bumper of this invention may be manufactured as a lower cost while exhibiting greater reliability.

The above has been offered for illustrative purposes only, and is not intended to limit the scope of the invention of this application, which is as defined in the claims below.

That which is claimed is:

1. In a bumper for a pinball game which comprises: a depressible flange for contact with a rolling ball; a vertically movable pin engaging said flange and positioned to move between a first vertical position when the flange is depressed and a second vertical position when the flange is not depressed; spring means to urge said vertically movable pin toward one of said vertical positions; switch means which is actuated between open and closed positions as the pin moves between the first and second vertical positions; pivotable arm means having a pivot point and a free end, said arm means engaging the end of said vertically movable pin at a first position between said pivot point and free end, said arm means also engaging said switch means at a second position closer to said free end than said first position, whereby movements of said pin can cause said engaging of said switch means in magnified manner; and function means actuated by said switch means.

2. The bumper of claim 1 in which said function means comprises means for thrusting the ball away from the bumper when the vertically movable pin is moved to a vertical position other than the position toward which the spring means urges.

3. The bumper of claim 1 in which said spring means urges said pin toward the second vertical position.

4. The bumper of claim 1 in which said depressible flange defines one face that is in nonadhering contact with an end of the vertically movable pin, whereby rotating depression of a portion of said flange causes linear, vertical movement of the pin from one vertical position to the other.

5. The bumper of claim 4 in which said depressible flange defines a face opposed to said one face and said bumper defines a stationary abutment that is in nonadhering contact with said opposed face.

6. The bumper of claim 1 in which said depressible flange defines a circular periphery.

7. The bumper of claim 6 in which said depressible flange defines a plurality of apertures, and stationary vertical members loosely extending through said apertures for retention of said flange.

8. The bumper of claim 1 in which said switch means comprises a mechanical switch.

9. In a bumper for a pinball game which comprises; a depressible flange for contact with a rolling ball, and function means comprising means for thrusting the ball away from the bumper; a vertically moveable pin engaging said flange and positioned to move between a first vertical position when the flange is depressed and a second vertical position when the flange is not depressed; spring means to urge said vertically moveable pin toward the second vertical position; mechanical switch means which is actuated between open and closed positions as the pin moves between the first and second vertical positions; pivotable arm means having a pivot point and a free end, said arm means engaging the end of said vertically movable pin at a first position between said pivot point and free end, said arm means also engaging said switch means at a second position closer to said free end than said first position, whereby movements of said pin cause movements of said switch means in magnified manner; said function means being actuated by the switch means when the vertically moveable pin is moved to the first position.

10. The bumper of claim 9 in which said depressible flange defines a circular periphery.

11. The bumper of claim 9 in which said depressible flange defines a plurality of apertures, and stationary vertical members loosely extending through said apertures for retention of said flange.

12. In a bumper for a pinball game which comprises a depressible flange of circular periphery for contact with a rolling ball; a vertically moveable pin engaging said flange and positioned to move in linear manner between a first vertical position when the flange is depressed and a second vertical position when the flange is not depressed; spring means to urge said vertically moveable pin toward one of said vertical positions; switch means which is actuated between open and closed positions as the pin moves between the first and second vertical positions; pivotable arm means having a pivot point and a free end, said arm means engaging the end of said vertically movable pin at a first position between said pivot point and free end, said arm means also engaging said switch means at a second position closer to said free end than said first position, whereby movements of said pin can cause said engaging of said switch means in magnified manner; and function means actuated by said switch means; said depressible flange defining one face that is in nonadhering contact with an end of the vertically moveable pin, whereby rotating depression of a portion of said flange causes linear, vertical movement of the pin from one vertical position to the other.

13. The bumper of claim 12 in which said depressible flange defines a face opposed to said one face and said bumper defines a stationary abutment that is in nonadhering contact with said opposed face.

14. The bumper of claim 13 in which said depressible flange defines a plurality of apertures, and stationary vertical members loosely extending through said apertures for retention of said flange.

15. The bumper of claim 14 in which said function means comprises means for thrusting the ball away from the bumper when the vertically moveable pin is moved to the vertical position other than the position toward which the spring means urges.

16. The bumper of claim 15 in which the spring means urges said pin toward the second vertical position.

17. The bumper of claim 12 in which said switch means comprises a mechanical switch.

* * * * *